United States Patent [19]

Thompson

[11] Patent Number: 4,608,513

[45] Date of Patent: Aug. 26, 1986

[54] DUAL FILAMENT ION SOURCE WITH IMPROVED BEAM CHARACTERISTICS

[75] Inventor: William B. Thompson, Rockport, Mass.

[73] Assignee: Varian Associates, Inc., Palo Alto, Calif.

[21] Appl. No.: 650,014

[22] Filed: Sep. 13, 1984

[51] Int. Cl.[4] ..... H05H 00/00

[52] U.S. Cl. ..... 313/359.1; 315/111.91

[58] Field of Search ..... 313/359.1, 361.1, 362.1; 315/111.81, 111.91; 250/425, 426, 427

[56] References Cited

U.S. PATENT DOCUMENTS 2,848,622 8/1958 Oppenheimer ..... 250/426

2,874,296 2/1959 Lofgren ..... 313/359.1

3,483,423 12/1969 Hanks ..... 313/453

4,288,716 9/1981 Hinckel et al. ..... 315/111.81

4,412,153 10/1983 Kalbfus et al. ..... 315/111.81

*Primary Examiner*—David K. Moore

*Attorney, Agent, or Firm*—Stanley Z. Cole; William R. McClellan

[57] ABSTRACT

A Freeman type electron bombardment ion source includes dual filament electrodes positioned in an arc chamber having a slit for extraction of an ion beam. The filament electrodes are symmetrically positioned with respect to the extraction slit. The filament electrode currents are equal in magnitude and oppositely directed. As a result, lateral magnetic fields in the region of the extraction slit are substantially eliminated.

4 Claims, 4 Drawing Figures

DUAL FILAMENT ION SOURCE WITH IMPROVED BEAM CHARACTERISTICS

BACKGROUND OF THE INVENTION

This invention relates to electron bombardment ion sources and, more particularly, to an ion source having a dual filament configuration which improves the characteristics of the output ion beam.

Ion sources are utilized in a variety of charged particle beam systems including research accelerators, ion beam etching and ion implantation. A variety of ion source types have been developed, as described by D. Aitken in "Ion Sources,"*Ion Implantation Techniques,* Springer-Verla, 1982, pp. 23–71. In commercial ion implantation equipment, it is desirable to have an ion source which is reliable, relatively energy-efficient and which has a long lifetime. In addition, the ion beam produced by the source must have well-defined characteristics in order to insure that microminiature semiconductor devices can be fabricated on a production basis. A commonly used source for ion implantation is the heated cathode Freeman ion source. A filament is located in an ionization chamber generally parallel to an exit aperture through which ions produced in the chamber are extracted. The filament is negatively biased with respect to the chamber walls and is heated to emission temperature to supply electrons for electron impact ionization of gases introduced into the chamber. The electron impact ionization of the gas creates a plasma. Positive ions are extracted from the plasma by means of a high potential field and emerge through the exit aperture in the wall of the ionization chamber as an ion beam to be used for implantation.

In general, the ion implanter must produce a beam with a small, uniform cross-section at the target over a large range of currents and energies. The beam, after exiting the source, is required to pass through ion optical elements including a mass analyzer, an accelerator, lens elements and a beam scanner. For efficient transmission through these elements, the beam profile and divergence at the output of a source must be controlled. Prior art efforts in producing a well-defined ion beam at the output of the ion source have centered on variations in the position, shape and applied voltage of the extraction electrodes.

It is a general object of the present invention to provide novel, electron bombardment ion sources.

It is another object of the present invention to provide ion sources with improved beam characteristics.

It is still another object of the present invention to provide ion sources wherein magnetic fields in the region of the extraction slit lateral to the ion beam and resulting from filament electrodes are substantially eliminated.

SUMMARY OF THE INVENTION

According to the present invention, these and other objects and advantages are achieved in an ion source comprising a housing which defines an internal arc chamber and includes an aperture for extraction of an ion beam and at least two filament electrodes for thermionic emission of electrons positioned in the arc chamber. The ion source further includes means for supplying electrical current through the filament electrodes for heating thereof in opposite directions such that, in the region of the extraction slit, the net magnetic field produced by the electrodes in a direction lateral to the ion beam is approximately zero. The ion source still further includes means for biasing the housing at a more positive potential than the filament electrodes, means for imposing a magnetic field on the arc chamber generally parallel to the filament electrodes and means for introducing an ionizable material into the arc chamber. In a preferred embodiment, the electrodes are parallel and symmetrically positioned with respect to the extraction slit and are supplied with currents equal in magnitude.

BRIEF DESCRIPTION OF THE DRAWINGS

For a better understand of the present invention, together with other and further objects, advantages and capabilities thereof, reference may be had to the accompanying drawings which are incorporated herein by reference and in which.

DETAILED DESCRIPTION OF THE INVENTION

Figure 1:
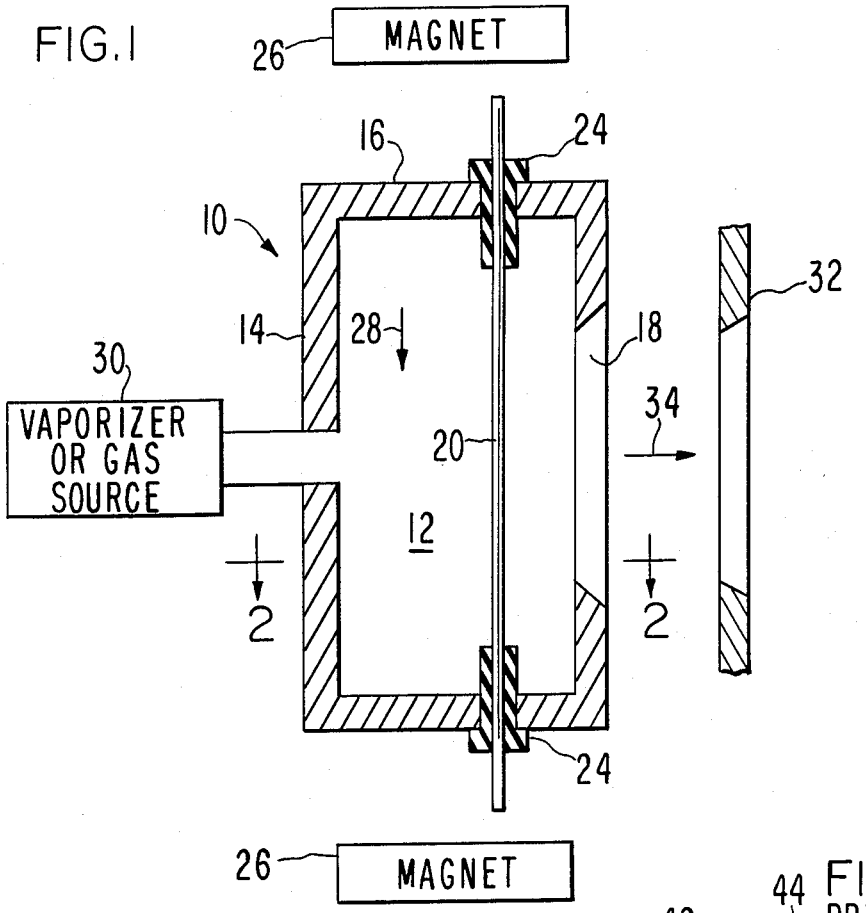
FIG. 1 is a simplified cross-sectional view of an ion source in accordance with the present invention.
Figure 2:
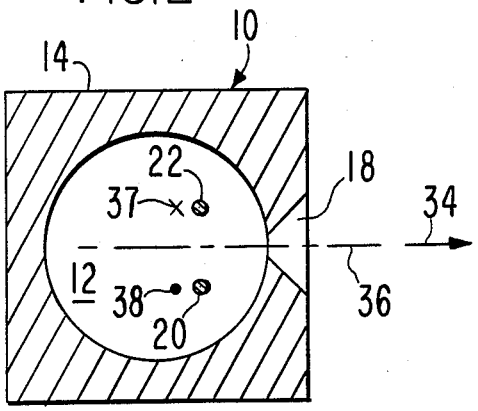
FIG. 2 is a cross-sectional view of the ion source of FIG. 1 taken through the line 2—2 of FIG. 1.

A simplified diagram of an ion source, in accordance with the present invention, is shown in FIGS. 1 and 2. A housing 10 of a metal, such as molybdenum, defines a generally cylindrical arc chamber 12. The housing 10 includes a side wall 14 and an end wall 16. An elongated extraction slit 18 is formed in the side wall 14 parallel to the axis of the cylindrical arc chamber 12. Positioned in the arc chamber 12 are a filament electrode 20 and a filament electrode 22. In the example of FIGS. 1 and 2, the filament electrodes 20, 22 are elongated rods parallel to the axis of the arc chamber 12 and to the extraction slit 18. Insulators 24 electrically isolate the electrodes 20, 22 from the housing 10. The ion source further includes magnets 26 external to the housing 10 for producing a magnetic field 28 generally parallel to the electrodes 20, 22. The arc chamber 12 is coupled through the side wall 12 by a conduit to a source 30 of ionizable material which can be a gas source or a vaporizer. A variety of materials, including $BF_3$, $PH_3$ and $AsH_3$, may be ionized in the source 30. An extraction electrode 32 is positioned external to the arc chamber 12 in proximity to the extraction slit 18. The extraction electrode 32 imposes an electric field in the vicinity of the extraction slit 18 adapted for extraction of a well-defined ion beam 34. During operation, the ion source is typically maintained at a vacuum on the order of $10^{-2}$ Torr.

In the embodiment of FIGS. 1 and 2, filament electrodes 20, 22 are positioned symmetrically in the arc chamber 12 with respect to the extraction slit 18. The electrodes 20, 22 are spaced equidistant from an imaginary line 36 drawn between the center of the arc chamber 12 and the center of the extraction slit 18. Thus, the extraction slit 18 is equidistant along its length from the electrodes 20, 22. The filament electrodes 20, 22 are material, such as tungsten, which is a good thermionic emitter. The filament electrodes 20, 22 are coupled to a power supply (not shown) which typically supplies a current on the order of 150 amps. In accordance with the present invention, the electrodes 20, 22 are connected so that current flows in opposite directions, as indicated at 37, 38 (into and out of the paper, respectively) in FIG. 2. This can be accomplished by connecting the two electrodes 20, 22 together at one end of the ion source. The opposite ends of the electrodes 20, 22 are connected to the positive and negative terminals, respectively, of a power supply. Thus, although the electrodes 20, 22 are mechanically positioned in parallel, they are electrically connected in series. Alternatively, the electrodes 20, 22 can be connected to separate power supplies which supply the currents equal in magnitude and opposite in direction through the two electrodes.

Figure 3:
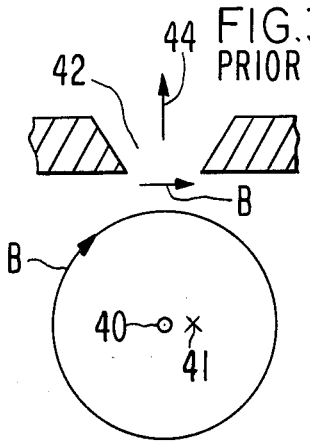
FIG.3 PRIOR ART
FIG. 3 illustrates the magnetic fields in the region of an extraction aperture in accordance with the prior art.

Prior art electron bombardment ion sources have utilized a single filament electrode positioned in line with the extraction slit. This configuration is shown in partial cross-sectional view in FIG. 3. A filament electrode 40, with current flowing in the direction indicated at 41 (into the paper), is positioned in line with an extraction slit 42. An ion beam 44 is extracted through the slit 42. The filament electrode 40 produces concentric magnetic fields, as indicated at B. In the region of the extraction slit 42, the fields are perpendicular to the direction of the ion beam 44 and exert a force on the ions in the beam 44 which deflects the ions off the beam axis. The amount of deflection depends on the mass and energy of the ions. The direction of the force produced by a lateral magnetic field is up or down along the axis of the slit. It has been observed in prior art ion sources that the vertical position of the ion beam varies somewhat with different ion species. A dual filament ion source is disclosed in U.S. Pat. No. 4,412,153, issued Oct. 25, 1983, and assigned to assignee of the present application. There is shown an embodiment wherein current passes through two parallel filaments in the same direction. It can be seen that this configuration produces a lateral magnetic field in the region of the extraction slit similar to the case of the single filament electrode, since the lateral components of the magnetic field from each of the two filaments are summed.

Figure 4:
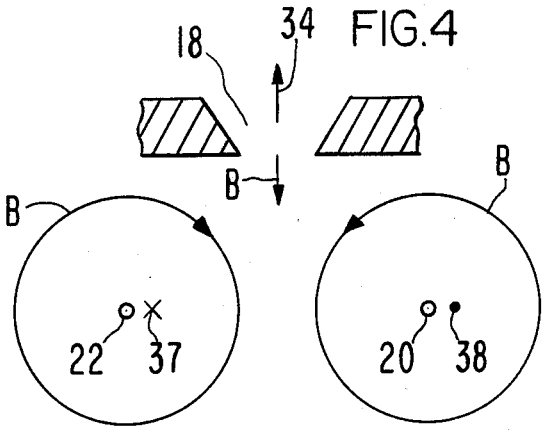
FIG. 4 illustrates the magnetic fields in the region of the extraction aperture in accordance with the present invention.

Referring now to FIG. 4, there is shown a partial cross-sectional view of the ion source of FIGS. 1 and 2, which illustrates the magnetic fields in the region of the extraction slit 18. Since the currents through the filament electrodes 20, 22 are opposite in direction, the resulting concentric magnetic field lines, as indicated by B, are also opposite in direction. In the region of the extraction slit, the components of the magnetic field produced by the electrodes 20, 22 lateral to the direction of the ion beam 34 are opposite in direction and equal in magnitude. Thus, the lateral fields cancel, and there is no lateral magnetic field to deflect the ion beam 34. In the direction parallel to the ion beam 34, the magnetic fields from the electrodes 20, 22 add. However, since this magnetic field component is parallel to the direction of the ion beam 34, there is no force exerted upon the ions in the beam. Thus, the ion beam 34, as it passes through the extraction slit 18, is not subjected to magnetic fields resulting from current flow through the filament electrodes 20, 22.

In operation, electrons are supplied to the arc chamber 12 by the filament electrodes 20, 22 and ionizable gas molecules, such as phosphine, are supplied by the source 30. A discharge is formed in the arc chamber 12 with electrons causing ionization of neutral gas molecules. The positive ions are extracted from the plasma through the extraction slit 18 and form the ion beam 34. The magnetic field 28 promotes ionization efficiency in the well-known manner.

The example illustrated in FIGS. 1, 2 and 4 and described hereinabove, includes filament electrodes 20, 22 positioned equidistant from the slit, parallel to each other, and carrying equal but oppositely directed currents. It will be understood that this is but one example of an ion source in accordance with the present invention. A more general requirement is that the filament electrodes be configured so that there is no component of the magnetic field lateral to the direction of the ion beam in the region of the extraction slit. This can be accomplished by a variety of configurations. For example, when the filament electrodes are not equidistant from the extraction slit, the current levels through the electrodes can be adjusted in magnitude to produce cancelling lateral magnetic fields in the region of the extraction slit. Furthermore, the electrodes need not be parallel to each other or to the extraction slit, provided that the above criterion for lateral magnetic fields in the region of the extraction slit is met. Alternatively, the relative magnitudes of the currents through the two filament electrodes can be adjusted to apply controlled, magnetic fields to the beam and to adjust the parameters of the beam.

While there has been shown and described what is at present considered the preferred embodiments of the invention, it will be obvious to those skilled in the art that various changes and modifications may be made therein without departing from the scope of the invention as defined by the appended claims.

I claim:

1. An ion source comprising:

a housing which defines an internal arc chamber and includes an extraction slit for extraction of an ion beam;

at least two filament electrodes for thermionic emission of electrons positioned in said arc chamber;

means for supplying electrical current through said filament electrodes for heating thereof in opposite directions such that, in the region of said extraction slit, the net magnetic field produced by said electrodes in a direction transverse to said ion beam is approximately zero;

means for biasing said housing at a more positive potential than said filament electrodes;

means for imposing a magnetic field on said arc chamber generally parallel to said filament electrodes; and means for introducing an ionizable material into said arc chamber.

2. The ion source as defined in claim 1 wherein said filament electrodes are parallel to each other and parallel to said extraction slit.

3. The ion source as defined in claim 2 wherein said filament electrodes are symmetrically positioned with respect to said extraction slit and are supplied with currents equal in magnitude.

4. The ion source as defined in claim 3 wherein said filament electrodes are electrically connected in series.

* * * * *